US006816050B2

(12) United States Patent
Just et al.

(10) Patent No.: US 6,816,050 B2
(45) Date of Patent: Nov. 9, 2004

(54) SIZE-REDUCED MAGNET COIL CARRIER

(75) Inventors: Bernhard Just, Kernen (DE); Nestor Rodriguez-Amaya, Stuttgart (DE); Uwe Schmidt, Vaihingen/Engingen (DE); Ramon Junker, Kirkel (DE); Thomas Christmann, Neuendorf (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/451,573

(22) PCT Filed: Jul. 13, 2002

(86) PCT No.: PCT/DE02/02580

§ 371 (c)(1),
(2), (4) Date: Dec. 8, 2003

(87) PCT Pub. No.: WO03/038844

PCT Pub. Date: May 8, 2003

(65) Prior Publication Data

US 2004/0090294 A1 May 13, 2004

(30) Foreign Application Priority Data

Oct. 22, 2001 (DE) ..... 101 51 955

(51) Int. Cl.[7] ..... H01F 3/00

(52) U.S. Cl. ..... 335/296; 335/299; 336/90; 336/92; 336/96; 336/192

(58) Field of Search ..... 335/396–300; 336/90–96, 192

(56) References Cited

U.S. PATENT DOCUMENTS

| | | | |
|---|---|---|---|
| 4,453,700 A | 6/1984 | Otsuki et al. | 251/129 |
| 5,331,730 A | 7/1994 | Brinn, Jr. | 29/606 |

FOREIGN PATENT DOCUMENTS

| | | |
|---|---|---|
| DE | 197 15 234 | 6/1998 |
| DE | 197 14 812 | 10/1998 |
| EP | 0 138 408 | 4/1985 |
| EP | 657 642 | 6/1995 |
| JP | 11 073660 | 3/1999 |
| WO | WO 96/30441 | 10/1996 |

*Primary Examiner*—Ramon M. Barrera
(74) *Attorney, Agent, or Firm*—Kenyon & Kenyon

(57) ABSTRACT

A magnet system having a magnet coil surrounded by a magnet pot is provided, the magnet coil being electrically connected to contact prongs, an interspace being formed between the outside of the magnet coil and the inside of the magnet pot, in which interspace a free-flowing compound is cast. The magnet coil is surrounded by a thin-walled coil insulating frame on which tubular contact guide elements are integrally molded. The thin-walled coil insulating frame is made of a thermally stable plastic material mixed with mineral fillers.

12 Claims, 3 Drawing Sheets

SIZE-REDUCED MAGNET COIL CARRIER

FIELD OF THE INVENTION

The present invention relates to a magnet system having a magnet coil surrounded by an insulating frame.

BACKGROUND INFORMATION

Magnet coils may be used with fuel injectors of fuel supply systems for internal combustion engines. In the case of magnet coils of solenoid valves, there is a general requirement that the switching dynamics be improved to achieve short switching times and to prevent excessive heating of the electromagnet through good heat dissipation.

Published German Patent Application No. 197 15 234 discloses a direct injection fuel injector having magnetic control for accumulator injection systems. The fuel injector includes in each valve housing a supply line which leads to a spring-loaded nozzle needle and which may be closed by a control piston having a valve function; also included is a nozzle needle spring which is supported in a spring space and presses the nozzle needles onto their needle seats. A control space is provided on the rear side of the control piston, which is under system pressure. The control space is connectable to a relief line by a solenoid valve, and simultaneously with the injection, the closing of the supply line leading to the nozzle needle may be canceled by a high-pressure valve situated on the control piston. Furthermore, a throttled line connection is provided as a bypass between the supply line and the relief line in the fuel injector, the line connection containing a leakage valve mechanically connected to the solenoid valve, so that the line connection may be interrupted by this valve during the injection.

Published European Patent Application No. 657 642 discloses a fuel injection system for internal combustion engines. The fuel injection system for internal combustion engines includes a high-pressure collecting space which may be filled by a high-pressure fuel pump, and which has high-pressure lines leading away from it to the individual injectors. Control valves are used in the individual high-pressure lines to control the high-pressure injection at the injectors, and an additional accumulator space is provided between these control valves and the high-pressure collecting space. To prevent the high system pressure from being applied continuously to the injectors, the control valve is designed so that it closes its connection to the accumulator space during the injection pauses at the injectors, and it notches up a connection between the injectors and a relief space. The control valve is designed as a 3/2-way valve in which a piston-shaped valve member is actuated by an electric actuator magnet which acts on its one end face opposite a compression spring supported between the housing and a spring plate on the valve member. The electric actuator magnet receives electric power from a control unit.

Published German Patent Application No. 197 14 812 discloses a conventional magnet coil. The conventional magnet coil is formed by a winding wire wound onto a winding carrier. Such a magnet coil is used, e.g., in solenoid valves, which are used in fuel pumps of internal combustion engines to control the pump delivery rate and the course of delivery. During operation, fuel under a high pressure flows around the solenoid valves at least to some extent. The magnet coil must be encapsulated to prevent it from coming in contact with the fuel. In the case of common-rail fuel injection systems or pump-nozzle units in particular, solenoid valves having extremely short switching times are needed. The short switching times result in heating of the magnet coil during operation, and therefore dissipation of heat at the magnet coil must be ensured, because a thermal burden on the coil during operation is not desirable.

A frameless magnet coil including a winding accommodated in a magnet pot is known in the art. The winding is formed in particular from baked enamel wire, which is provided with a coating to ensure cohesion of the winding of the magnet coil. The magnet coil winding is situated in a toroidal cup. Interspaces between the coil and the magnet pot are reduced significantly by securing the coil and pot using a casting compound. This also yields an improvement in dynamics and in heat dissipation. On the other hand, problems occur with respect to handling, correct positioning and the risk of an electric short circuit between the coil wire and the magnet pot, as well as the risk of cavities forming in the casting compound. Furthermore, leakage may occur at the outlet of the magnet pot due to an undefined position of the coil wire, so that this arrangement has some disadvantages.

SUMMARY OF THE INVENTION

In accordance with an embodiment according to the present invention, by using an extremely thin-walled coil insulating frame, it is possible to use magnets which have a very small defined interspace between the bobbin and the magnet pot, so that an extremely miniaturized embodiment of electromagnets becomes possible. Through the embodiment according to the present invention, handling of very small magnet coils having an average diameter of less than 5 mm to 6 mm may be facilitated; furthermore, the magnet coils surrounded by a thin-walled bobbin may be positioned inside the magnet pot with very high precision. Due to the arrangement of the coil insulating frame in the magnet pot, there is a uniform gap for the introduction of casting compound, so the casting compound flows uniformly within the gap, and unwanted cavities cannot develop in the casting compound, nor is there any accumulation of material or areas having unacceptably thin walls. A non-uniform distribution of casting compound in the annular gap between the electromagnet and the magnet pot has a negative effect on the dissipation of heat and should be avoided.

Short-circuiting between the coil and the magnet pot is prevented by using coil insulating frames having thin walls, e.g., walls less than 200 $\mu$m to 300 $\mu$m thick.

In one embodiment of the proposed thin-walled coil insulating frame, tubular projections may be mounted on it, permitting easier insertion of contact prongs. Furthermore, the space reserved by the thin-walled coil insulating frame may be filled with a casting compound that hardens.

Use of a thin-walled coil insulating frame prevents damage to components during assembly or handling of the components; such damage could have a considerable effect on the subsequent functionality of an assembled electromagnet coil.

The present invention permits an interaction of well-defined, uniform interspaces between the coil and the magnet pot, so that casting/injection of a free-flowing compound is facilitated, resulting in magnets that are optimized with regard to dissipation of heat.

DETAILED DESCRIPTION

Figure 1:
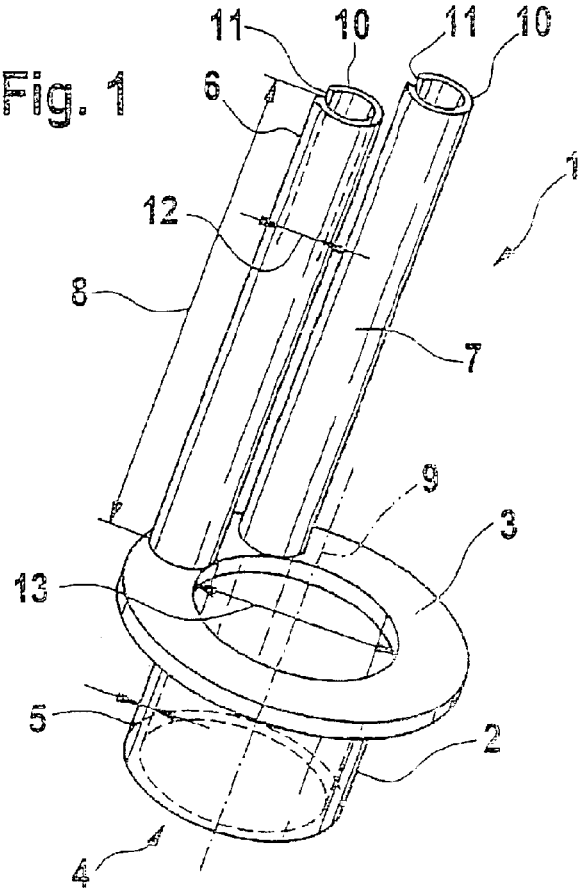
FIG. 1 shows a coil insulating frame according to the present invention, which is open on the side opposite the contact bushings.

FIG. 1 shows a diagram of a coil insulating frame created so that it is open on the side opposite the contact bushings.

Coil insulating frame 1 shown in FIG. 1 is preferably made of a high-performance thermoplastic material and/or a thermoset plastic having $T_G \geqq 120°$ C., where $T_G$ denotes the glass transition temperature at which the transition to plastification begins. To improve the thermal conductivity, mineral fillers are added to the thermoplastic material used here, be it a high-performance thermoplastic or a thermoset plastic.

Thin-walled coil insulating frame 1 has in its lower area a jacket 2 ending in an open end 4. The top side of the jacket area of thin-walled coil insulating frame 1 is bordered by an annular cover element 3. Wall thickness 5 of the jacket area of thin-walled coil insulating frame 1 may be in the range between 200 $\mu$m and 300 $\mu$m, and the thickness may be below this range. On the side of annular cover section 3 of thin-walled coil insulating frame 1 facing away from open end 4, two tubular contact guides 6 and 7 are integrally molded with a distance between them. Tubular contact guides 6 and/or 7 extend,parallel to axis 9 of thin-walled coil insulating frame 1 according to the diagram in FIG. 1. Instead of contact guide 6 and/or 7 extending parallel to axis 9 as shown in FIG. 1, this contact guide may be in any position in the vicinity of cover section 3. In this embodiment of a thin-walled coil insulating frame, the tubular contact guide elements are designed to have a first length 8. On the top side of the tubular contact guide elements 6 and/or 7, which may be integrally molded on the ring surface of annular cover section 3 of thin-walled coil insulating frame 1, end faces 10 are located. Axial slots 11 running parallel to axis 9 of thin-walled coil insulating frame 1 extend from end faces 10 of tubular contact guide elements 6 and/or 7. Slots 11 may extend over the entire first length 8 of tubular contact guide elements 6 and/or 7; in addition, it is also possible to provide slots 11 in the lateral surfaces of tubular contact guide elements 6 and/or 7 over only a portion of their first length 8.

Figure 3:
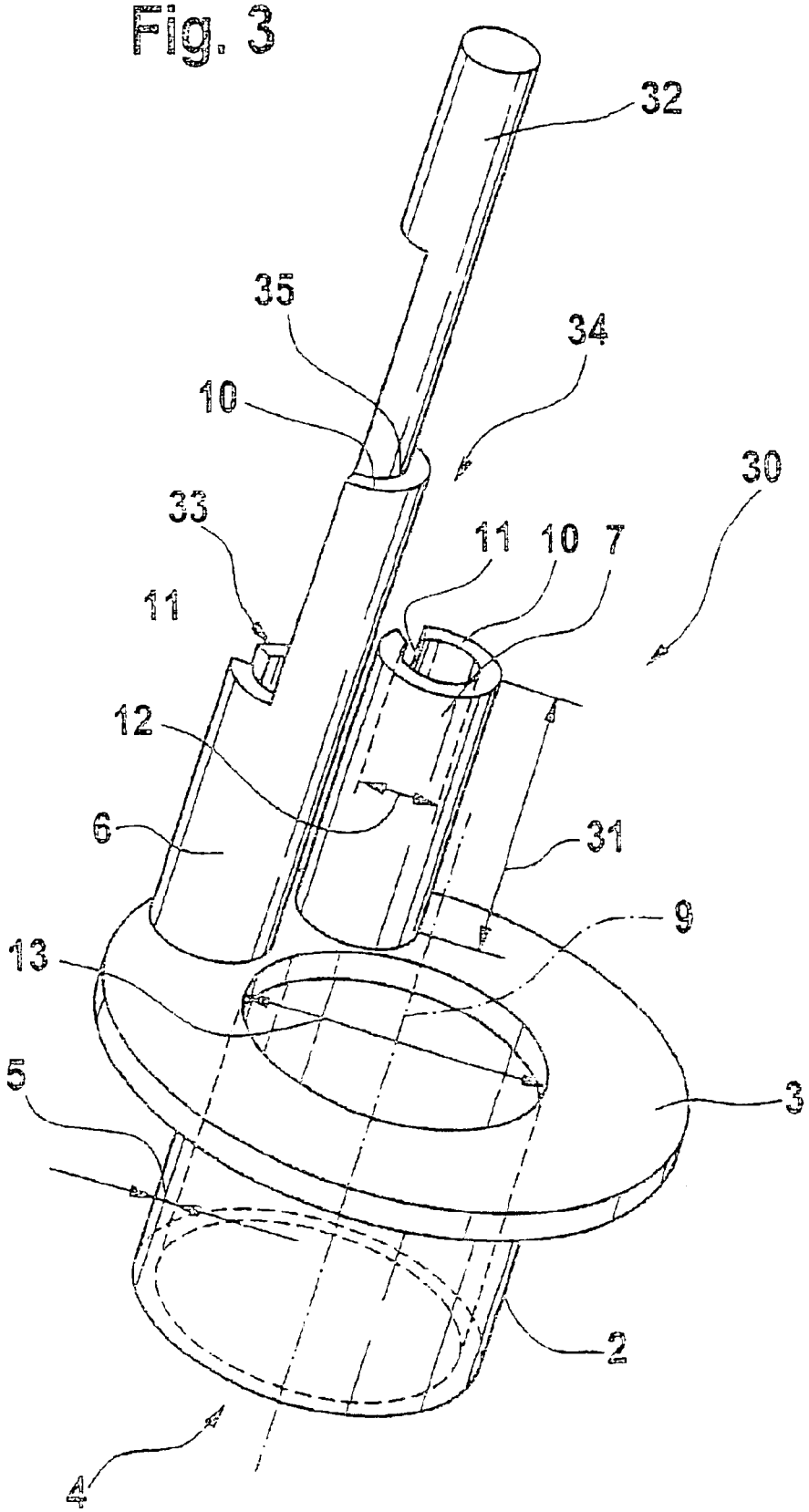
FIG. 3 shows a coil insulating frame according to the present invention, which has slotted insertion tubes to receive the contact prongs.

Inside diameter 12 of tubular contact guide elements 6 and/or 7 is coordinated with the outside dimensions of contact prongs 32 not shown in FIG. 1 (see diagram in FIG. 3). For the sake of thoroughness, it should be pointed out that the thin-walled coil insulating frame has inside diameter 13. Inside diameter 13 of the thin-walled coil insulating frame is the deciding factor for the inside diameter in the area of jacket section 2 of thin-walled coil insulating frame 1—although it is shown here in the area of annular cover section 3.

Figure 2:
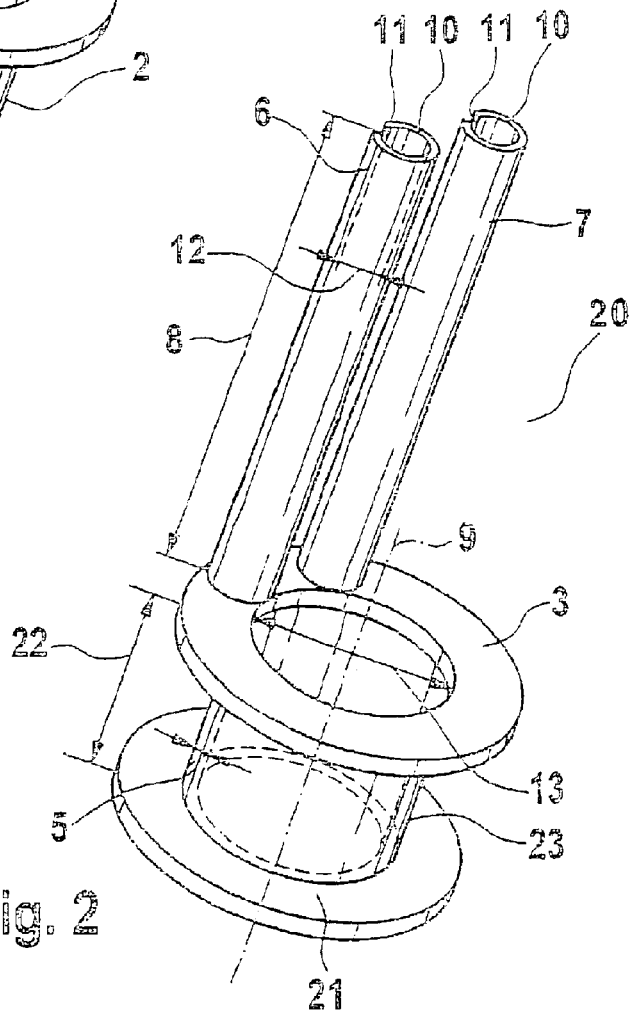
FIG. 2 shows a coil insulating frame of FIG. 1 having an integrally molded bottom area.

FIG. 2 shows a coil insulating frame according to the diagram in FIG. 1, but also with an integrally molded bottom part.

The additional embodiment of thin-walled coil insulating frame 20 according to the present invention shown in FIG. 2 differs from the first variant according to the diagram in FIG. 1 by a bottom area 21 which is integrally molded in the lower area of thin-walled coil insulating frame 20. Annular cover section 3 has an axial distance 22 from bottom area 21, which is integrally molded on the lower side of an outside lateral surface 23.

As in the diagram in FIG. 1, outside lateral surface section 23 of thin-walled coil insulating frame 20 according to the diagram in FIG. 2 is within an inside diameter 13.

In a manner similar to that in the first embodiment shown in FIG. 1, two integrally molded, tubular contact guide elements 6 and/or 7 are provided running parallel to axis 9 of thin-walled coil insulating frame 20 on the top side of annular cover section 3 of thin-walled coil insulating frame 20. These contact guide elements also include a longitudinal slot 11 running parallel to the axis of thin-walled coil insulating frame 20, which may cover the entire first length 8 of contact guide elements 6 and/or 7. However, longitudinal slot 11 in the lateral surfaces of tubular contact guide elements 6 and/or 7 may also extend over only a portion of first length 8 of tubular contact guide elements 6 and/or 7.

FIG. 3 shows a thin-walled coil insulating frame having slotted contact guide elements in which a contact prong is accommodated.

In contrast with the embodiment according to FIG. 2, tubular contact guide elements 6 and/or 7 have a length 31, which is different from first length 8, and/or with another length in the axial direction parallel to axis 9 of thin-walled coil insulating frame 30. Each tubular contact guide element 6 and/or 7 essentially has a circular cross section, and a longitudinal slot 11 running parallel to axis 9 of thin-walled coil insulating frame 30 may also be provided in the bordering wall of contact guide elements 6 and/or 7. First contact guide element 6 includes a shoulder 33. In the diagram according to FIG. 3, a contact prong 32 is inserted into the cavity of first contact guide element 6, which is integrally molded on the top side of annular cover section 3 of thin-walled coil insulating frame 30. The semicircular section of the lateral surface of first tubular contact guide element 6 extending above shoulder 33 functions as a guide surface 34 for contact prong 32, which is to be accommodated.

Second contact guide element 7 provided on the top side of annular cover section 3 is designed with a second axial length 31, its end face 10 being approximately at the level of shoulder 33 of first contact guide element 6. Second contact guide element 7 is also provided with a longitudinal slot 11 on its lateral surface, the slot extending from end face 10 downward in the direction of the top side of annular cover section 3 of thin-walled coil insulating frame 30 according to the diagram in FIG. 3. As in the embodiments of thin-walled coil insulating frame 1 and/or 20 according to the present invention shown in FIGS. 1 and 2, inside diameter 12 of contact guide elements 6 and/or 7 is adapted to the outside diameter of contact prongs 32. Inside diameter 13 of thin-walled coil insulating frame 1, 20 and/or 30 is adapted to the installation geometry in a magnet pot 40.

Wall thickness 5 of thin-walled coil insulating frame 1, 20 and/or 30, which is made of a thermally stable plastic material such as a high-performance plastic or a thermoset plastic mixed with mineral fillers, may be in the range between 200 $\mu$m and 300 $\mu$m, but may be less than this. A flow path/wall ratio $1/s \leqq 100$ is established. With this flow path/ wall ratio, relative length l is characterized in relation to width s of an interspace. The greater this ratio, the more difficult it is to introduce a casting compound, be it plastic or some other free-flowing material which subsequently hardens, into such a thin space extending over a great length. With a large flow path/wall ratio, a high pressure must be applied externally to achieve complete filling of the interspace defined by a flow path/wall ratio ≦100.

Due to the integral molding of tubular contact guide elements 6 and/or 7, this reserves an installation space for the insertion of contact prongs 32 with which the coil wire of magnet coil 41 to be accommodated by thin-walled coil insulating frame 1, 20, 30 is to be electrically connected. To increase the stability of the magnet coil, the coil wire of the magnet coil (not shown) in the thin-walled coil insulating frame according to the diagram in FIGS. 1 and 3 may be provided with a baked enamel wire coating, which may be baked by a current surge acting on it after winding of coil insulating frame 1, 20 and/or 30. After installation of a magnet coil prepared in this way in a magnet pot, thin-walled coil insulating frame 1, 20 and/or 30 may be inserted into a magnet pot 40 with magnet coil 41 accommodated on the frame and positioned accurately there. In the case of coils according to the diagram in FIG. 2, however, baked enamel wire coating may not be necessary.

Figure 4:
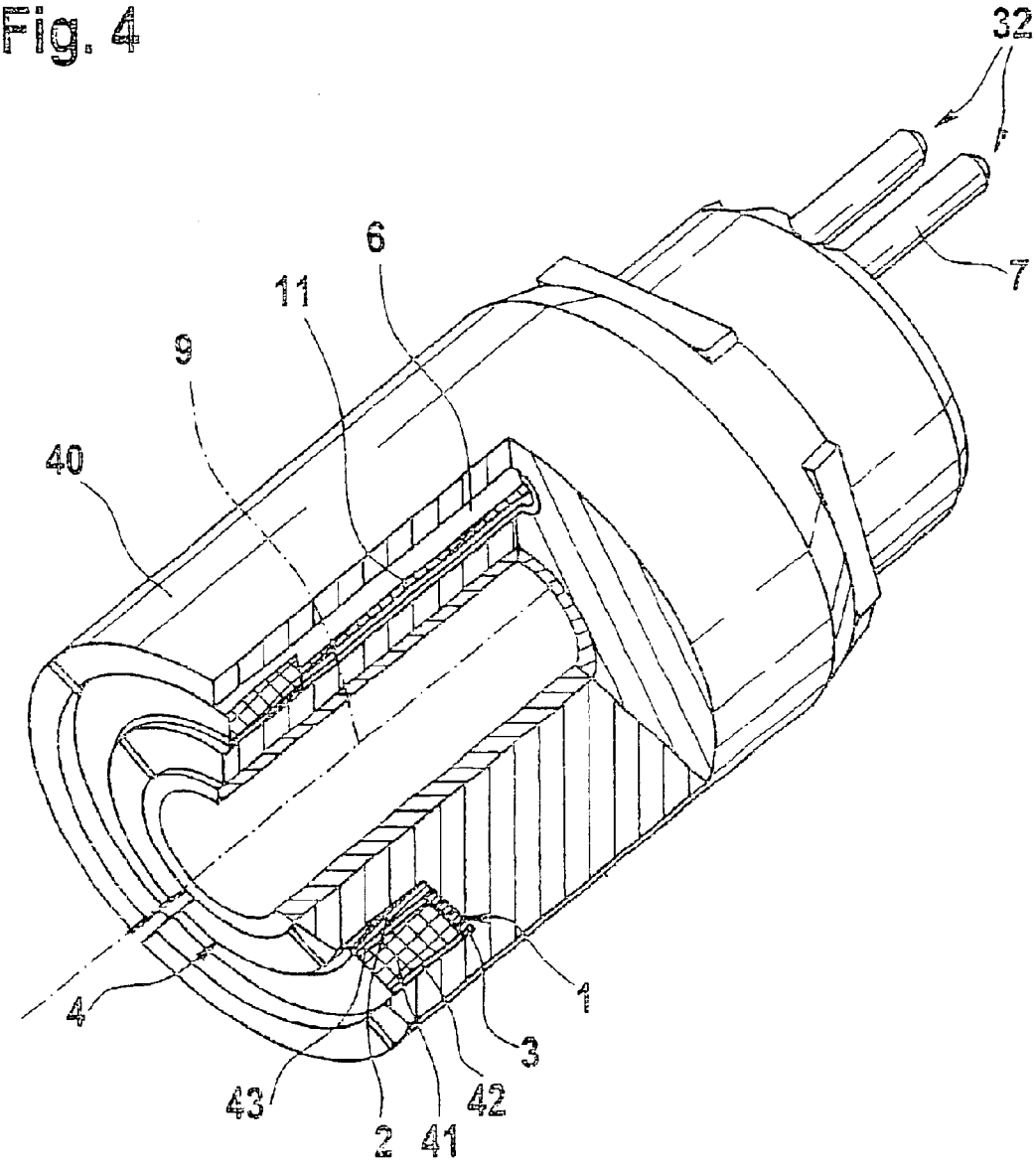
FIG. 4 shows a partial cut-away view of a magnet pot with a thin-walled coil insulating frame embedded therein, in accordance with the present invention.

FIG. 4 shows a partial cut-away diagram of a magnet pot having a thin-walled coil insulating frame accommodated therein.

Thin-walled coil insulating frame 1, which is shown in detail in FIG. 1, borders a magnet coil 41 inserted into a magnet pot 40 which partially surrounds it, as shown in FIG. 4. Lateral surface 2 and/or annular section 3 of thin-walled coil insulating frame 1 surround magnet coil 41 on the inside, and an interspace 42 is formed in the upper area between the outside of magnet coil 41, which may be stabilized by a baked enamel wire coating, and the inside of magnet pot 40. Another interspace 43 is provided between the inside of the interior lateral surface of thin-walled coil insulating frame 1 and the inside bordering wall of the annular groove for accommodating electromagnet 41 and thin-walled coil insulating frame 1. In the partially cutaway diagram according to FIG. 4, first contact guide element 6 having longitudinal slot 11 is shown, providing a contact option for contact prongs 32. First contact guide element 6 and/or the second contact guide element covered by it in FIG. 4 are in electrical connection to magnet coil 41, which is only indicated schematically here.

Due to the use of a thin-walled coil insulating frame 1, 20 and/or 30 made of a thermally stable material, preferably a plastic processable by injection molding, it is possible to achieve very small interspaces between magnet coil 41 and the inside of a magnet pot 40. The interspaces established when using a thin-walled coil insulating frame 1, 20 and/or 30 between the outside of magnet coil 41 and the inside of magnet pot 40 are uniform and permit a uniform flow of casting compound in the interspaces. An interspace on the inside 43 may occur because of the tolerances in the dimensions of the outside diameter of an inside pole and inside diameter 13 of the coil. An attempt should be made to insert the coil into magnet pot 40 without any great resistance, i.e., without contacting the walls, because otherwise there is the risk of damaging the coil wires. The interspace on the outside 42 is defined by the construction within the tolerances. By casting/injecting, i.e., introducing a free-flowing material into this interspace, it is possible to fill the interspace.

Optimum dissipation of heat through the lateral surface of magnet pot 40 may be achieved by the interaction of a material optimized with regard to thermal dissipation, e.g., thermoplastics and/or thermoset plastics to which a large amount of mineral filler has been added and a material to be cast in a uniformly developed interspace 42 between the outside of magnet coil 41 and the inside of magnet pot 40, thus greatly prolonging the lifetime of very small magnet coils 41.

What is claimed:

1. A magnet system, comprising:

a magnet pot;

a magnet coil surrounded by the magnet pot, the magnet coil being connected to at least one contact prong in an electrically conductive manner, wherein an interspace is formed between the outside of the magnet coil and the inside of the magnet pot, and wherein a free-flowing compound is introduced into the interspace; and a thin-walled coil insulating frame surrounding the inside of the magnet coil, wherein the thin-walled coil insulating frame has at least one tubular contact guide element integrally molded thereon, and wherein the thin-walled coil insulating frame is made of a thermally stable plastic material and mineral fillers.

2. The magnet system according to claim 1, wherein the thermally stable plastic material is a high-performance thermoplastic having $T_G \geqq 120°$ C., wherein $T_G$ represents the glass transition temperature at which the transition to plastification begins.

3. The magnet system according to claim 1, wherein the thermally stable plastic material is a thermoset plastic having $T_G \geqq 120°$ C., wherein $T_G$ represents the glass transition temperature at which the transition to plastification begins.

4. The magnet system according to claim 1, wherein the wall thickness (5) of the thin-walled coil insulating frame is between 200 $\mu$m and 300 $\mu$mn.

5. The magnet system according to claim 1, wherein the wall thickness of the thin-walled coil insulating frame is less than 200 $\mu$m.

6. The magnet system as recited in claim 1, wherein the thin-walled coil insulating frame is open at an end opposite the at least one tubular contact guide element.

7. The magnet system according to claim 1, wherein the thin-walled coil insulating frame includes an integrally molded annular bottom part on an end opposite the at least one contact guide element.

8. The magnet system according to claim 1, wherein the at least one contact guide element is positioned on an annular top cover of the thin-walled coil insulating frame and extend parallel to a longitudinal axis of the thin-walled coil insulating frame.

9. The magnet system according to claim 8, wherein the at least one contact guide element has a longitudinal slot which extends from a top end of the at least one contact element to the annular top cover of the thin-walled coil insulating frame.

10. The magnet system according to claim 8, wherein the at least one contact guide element includes a guide section for the at least one contact prong, the guide section being a semicircular shell.

11. The magnet system according to claim 1, wherein a flow-path-to-wall ratio of the thin-walled coil insulating frame is ≦100.

12. The magnet system according to claim 1, wherein the magnet coil is provided with a baked enamel coating adapted to be baked to increase the stability of the magnet coil.

* * * * *